United States Patent [19]

Matsumoto

[11] 4,230,264

[45] Oct. 28, 1980

[54] METHOD AND APPARATUS FOR CENTRIFUGAL SEPARATION OF COMPONENTS OF SOLUTION

[75] Inventor: Tetsuo Matsumoto, Hyogo, Japan

[73] Assignees: Akira Okumura, Hyogo; Shigemitsu Yamada, Tokyo; Fumiko Uozumi, Hyogo, all of Japan

[21] Appl. No.: 12,819

[22] Filed: Feb. 16, 1979

[30] Foreign Application Priority Data

Feb. 17, 1978 [JP] Japan ..... 53/17909
Sep. 29, 1978 [JP] Japan ..... 53/121065

[51] Int. Cl.[3] ..... B04B 11/06
[52] U.S. Cl. ..... 233/27; 233/14 R
[58] Field of Search ..... 233/27, 28, 34, 38, 233/21, 14 R, 14 A, 1 R; 422/72; 356/246

[56] References Cited

U.S. PATENT DOCUMENTS

| | | | |
|---|---|---|---|
| 3,219,266 | 11/1965 | Wagman | 233/28 |
| 3,586,484 | 6/1971 | Anderson | 233/27 |
| 3,864,089 | 2/1975 | Tiffany et al. | 422/72 |
| 3,890,101 | 6/1975 | Tiffany et al. | 422/72 |
| 4,091,989 | 5/1978 | Schlutz | 233/14 R |

*Primary Examiner*—George H. Krizmanich
*Attorney, Agent, or Firm*—Fleit & Jacobson

[57] ABSTRACT

A method and an apparatus for centrifugal separation of components of a solution in which a centrifugal rotor is employed so that different components are successively separated. The centrifugal rotor comprises a hollow body including at least one annular peripheral groove formed in the inside thereof and a series of depressions formed in the inside wall thereof, in which the annular groove and the depression at one end of the series are communicated with each other while the depressions at one end and the other end of the series are not communicated with each other and the adjacent depressions are communicated together through a communicating groove, whereby the solution injected into the annular groove is successively displaced and distributed through the respective depressions under the centrifugal effect while it is subjected to the centrifugal separation.

4 Claims, 11 Drawing Figures

METHOD AND APPARATUS FOR CENTRIFUGAL SEPARATION OF COMPONENTS OF SOLUTION

BACKGROUND OF THE INVENTION

The present invention relates to method and apparatus for centrifugal separation of components of a solution and, more particularly, a method for separating at least two components, having different sedimentation coefficients, of a solution in very short time, by using a centrifugal rotor of special construction, thereby separately collecting the desired components in rapid and efficient manner.

For example, when blood is collected from a patient to make blood test, it is desired that the amount of the blood collected be as little as possible, and the test result be obtained as early as possible. However, the processing of the blood in general blood test, particularly, the processing of centrifugal separation, requires time of at least fifteen minutes or more and substantial labor because such processing involves supplying of blood to a centrifugal tube, mounting of said tube on a centrifugal rotor, starting of rotation, stopping of the rotation, removing the tube from the rotor and separate collection or the like.

In order to overcome such defect, a continuously rotating centrifugal rotor system, so-called over-flow system, becomes used. In such system the blood is introduced from a predetermined side into the rotor while the blood subjected to centrifugal separation in the rotor is progressively discharged from the other side to the outside. This system, however, has a defect in which it requires considerable amount of blood and it can process only one blood.

SUMMARY OF THE INVENTION

The present invention aims at eliminating the defects in the conventional centrifugal separation of components of a solution.

Accordingly, it is an object of the present invention to provide a method and an apparatus for separating a sample in a centrifugal rotor in which the above described defects in the conventional method are completely avoided and the centrifugal separation can be performed easily and efficiently.

It is another object of the present invention to provide an apparatus for centrifugal separation which is used to realize the method according to the present invention, in which dilution of a sample liquid or analysis of components of the sample liquid, if desired, can be performed immediately.

Accordingly, the present invention provides a method and an apparatus for centrifugal separation of components of a solution in which a centrifugal rotor having special construction is employed so that the different components of the solution can be successively separated in very short time in intermittent and continuous manner, without requiring stopping the rotation of the centrifugal rotor and then the desired components can be separately collected, thereby providing considerable increase of the processing efficiency.

According to the present invention the centrifugal rotor comprises a hollow body which includes at least one annular peripheral groove formed in the inside thereof and a series of depressions formed in the inside wall thereof, in which said annular groove and the depression at one end of said series are communicated with each other, while the depressions at one end and the other end of said series are not communicated with each other and the adjacent depressions are communicated together by means of a communicating groove, whereby the solution injected into said annular groove is successively displaced and distributed through the respective depressions under the centrifugal effect while it is subject to centrifugal separation.

BRIEF DESCRIPTION OF THE DRAWINGS

The accompanying drawings illustrate preferred embodiments of the present invention in which.

DESCRIPTION OF THE PREFERRED EMBODIMENTS

Figure 1:
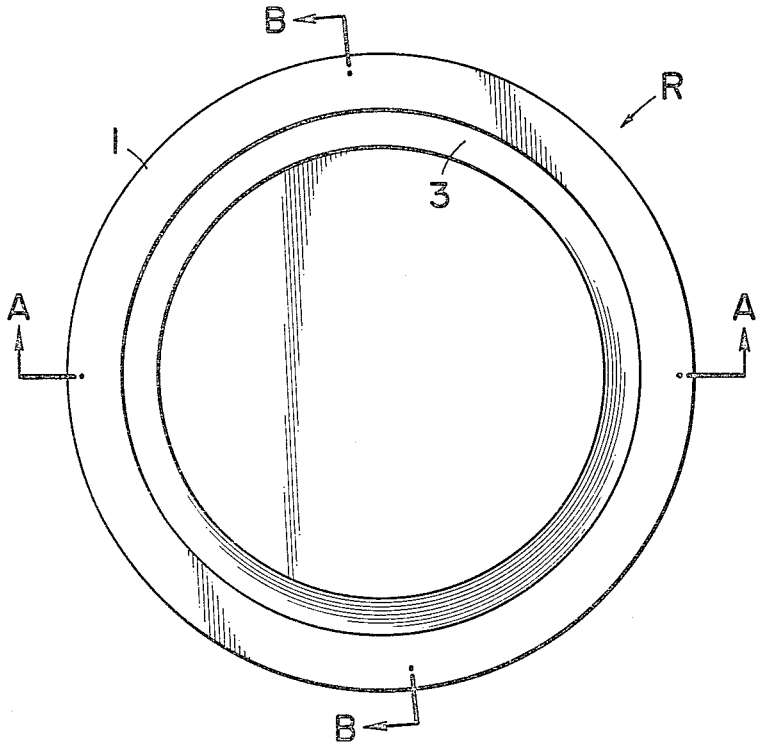
FIG. 1 is a plan view of a centrifugal rotor.
Figure 2:
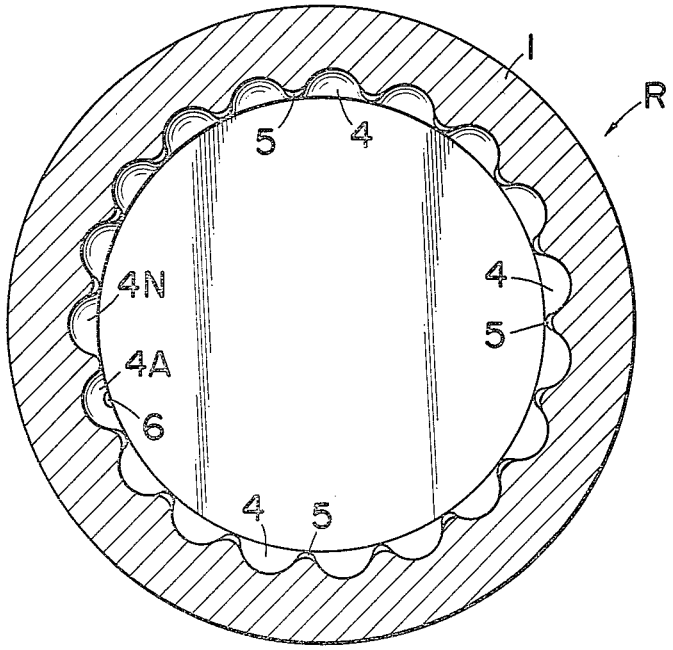
FIG. 2 is a horizontal sectional view of the rotor along a series of depressions formed therein.
Figure 3:
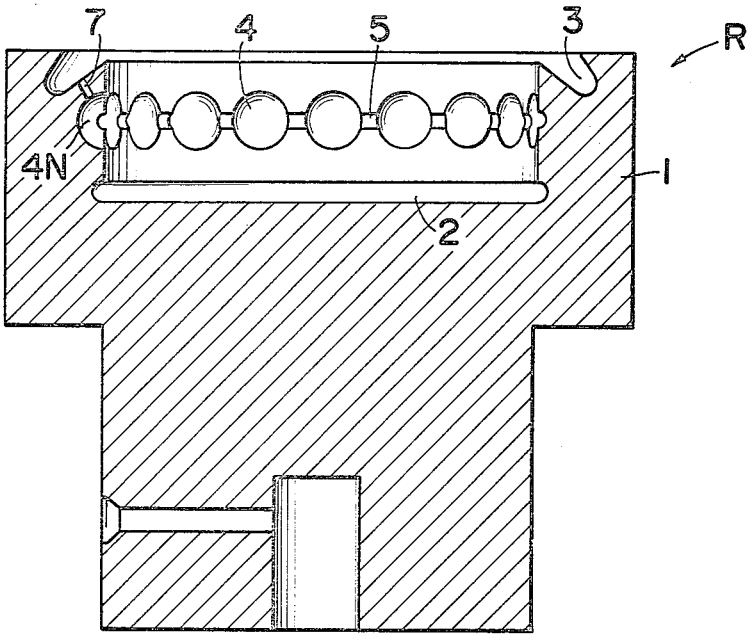
FIG. 3 is a vertical sectional view taken along a line A—A in FIG. 1.
Figure 4:
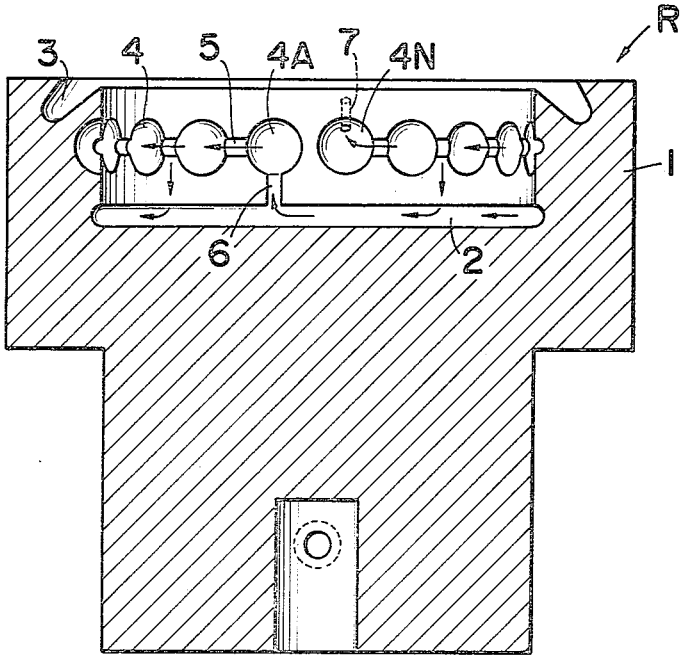
FIG. 4 is a vertical sectional view taken along a line B—B in FIG. 1.

Firstly, the principle of the present invention will be described with reference to FIGS. 1–5.

FIGS. 1–5 illustrate a device which comprises a centrifugal rotor R (which has a radius of rotation of 2 cm) consisting of a hollow body 1 having an open top and a closed bottom driven by a motor M. A peripheral annular groove 2 (which has a width of 1 mm and a depth of 1 mm) having an arcuately curved bottom if formed in the inside wall of said centrifugal rotor at the inside bottom thereof. At the top of the rotor, a further peripheral groove 3 opening toward the inside of the rotor is formed in the inside wall of said rotor, which has a concave, arcuate bottom and a slightly increased depth. Between said peripheral grooves 2 and 3, a series of arcuately curved depressions 4 . . . 4 are formed in the inside wall of said rotor at predetermined intervals and they are arranged in the rotating direction of the rotor. The adjacent depressions 4 in the series are communicated with each other through a communicating groove 5 having depth shallower than the depth of the depression, but the depression 4A at one end of said series is not communicated with the depression 4N at the other end of said series. One of the peripheral grooves 2 and the depression 4A at one end of said series are communicated with each other through a shallow communicating groove 6, while the other of the peripheral grooves 3 and the depression 4N at the other end of said series are communicated with each other through a communicating hole 7. Thus the centrifugal rotor R is constructed.

Figure 5:
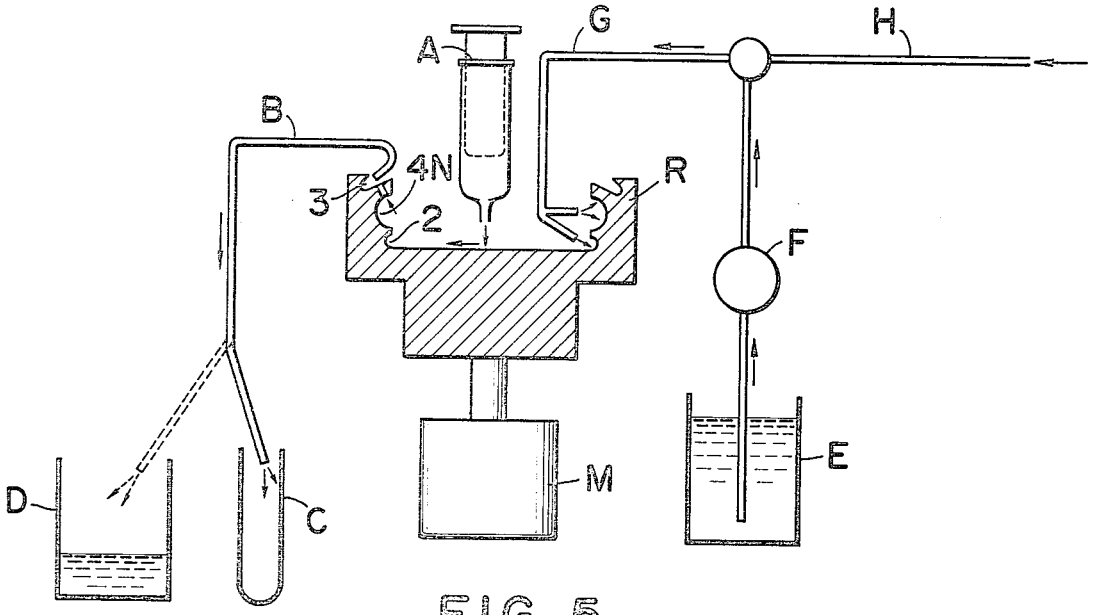
FIG. 5 is a diagrammatic view illustrating the operation of centrifugal separation of a sample, separate collection thereof and washing and drying of the inside of the rotor.

In the embodiment as shown in FIGS. 1–5, the centrifugal rotor is formed with twenty shallow depressions 4 having substantially semi-spherical shape, the total volume of said depressions being about 3 ml (each depression having a volume of about 0.15 ml), and the communicating hole 7 opens in the depression 4N at the position substantially coinciding with the position of the bottom of the communicating groove 5. Referring to FIG. 5, which illustrates the operation of centrifugal separation and separate collection, the device is shown as including a sample injector A, a tube B for discharging supernatant liquid having one end projecting into the annular groove 3, a receptacle C for receiving the supernatant liquid, a receptacle D for receiving the discharged washing liquid, a tank E of the washing liquid, a pump F, a tube G for introducing the washing liquid having bifurcated ends projecting into the annular groove 2 and the series of the depressions 4, respectively, and an air introducing tube H.

In operation, when 6 ml of blood added with a small amount of heparin is injected from the injector A to the bottom of the rotor at the rate of 3 ml/min, while the rotor is driven at 3000 RPM, the blood is passed, under the centrifugal effect, from the annular groove 2 through the communicating groove 6 into the depression 4A, then successively through the respective communicating grooves 5 and the respective depressions 4 into the depression 4N, then through the communicating hole 7 to the annular groove 3. About 1 minute after the commencement of the injection, the blood starts to flow into the annular groove 3. During the passage of the blood as above, the blood is separated in the respective shallow depressions 4 under the centrifugal effect at high efficiency, without producing slippage, so that the blood cells in the blood precipitate at the bottoms of the respective depressions 4 in rapid and reliable manner and only the supernatant liquid, namely blood plasma, flows into the annular groove 3. The blood plasma thus flowing into the annular groove is passed into the tube B, which leads the blood plasma to the outside of the apparatus, and is received by the receptacle C. Thus, at about two minutes after starting operation, the injection of the blood is finished, and at few seconds thereafter the discharging of the blood from the annular groove 2 terminates, so that about 3 ml of the blood plasma is separately collected into the receptacle C.

Then the free end of the discharging tube is moved to the receptacle D for receiving the discharged washing liquid. The rotating speed of the rotor is reduced to about 100–300 RPM and then the pump F is actuated to eject about 50 ml of the washing liquid from the washing liquid injecting tube G toward the inside wall of the rotor, thereby washing the inside of the rotor. Then the compressed air is ejected from the air introducing tube H toward the inside wall of the rotor, thereby drying the inside of the rotor. Thus one processing cycle is completed.

Then the rotating speed of the rotor is increased again to 3000 RPM, and the next amount of blood is injected into the rotor. Thus a predetermined amount of the blood is successively subjected to intermittent and continuous operation of separation and separate collection of the blood components in efficient manner.

The time required to complete the above operation includes about two minutes required to inject 6 ml of blood into the rotor at the rate of 3 ml/min and about 0.5–1 min. required to wash and dry the rotor, and consequently this apparatus can continuously process every 6 ml of blood in the period of 2.5–3 min.

Now, another example will be described with reference to FIGS. 6–10.

Figure 6:
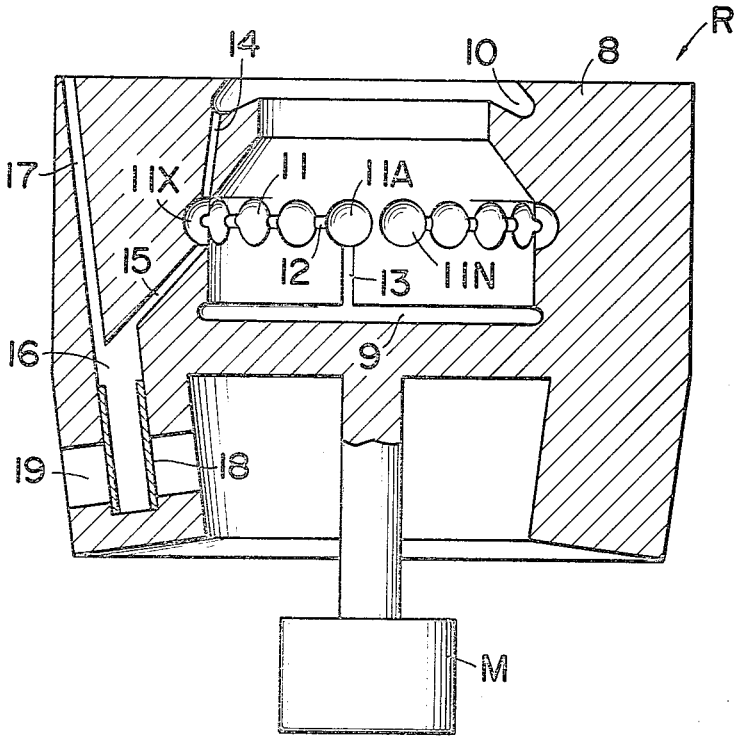
FIG. 6 is a sectional view showing an essential part of a modified form of the centrifugal rotor.

The system shown in FIGS. 6–10 comprises a centrifugal rotor R (which has a radius of rotation of 2 cm) which consists of a hollow body 8 having an open top and a closed bottom driven by a motor M. A peripheral annular groove 9 (which has a width of 1 mm and a depth of 1 mm) having an arcuately curved bottom is formed in the inside wall of said centrifugal rotor at the inside bottom thereof. At the top of the rotor, a further peripheral groove 10 opening toward the inside of the rotor is formed in the inside wall of said rotor, which has a concave, arcuate bottom and a slightly increased depth. Between said peripheral grooves 9 and 10, a series of arcuately curved depressions 11 . . . 11 are formed in the inside wall of said rotor at predetermined distances and they are arranged in the rotating direction of the rotor. The adjacent depressions 11 are communicated with each other through a communicating groove 12 having depth shallower than the depth of the depression, but the depression 11A at one end of said series of depressions is not communicated with the depression 11N at the other end of said series. One of the peripheral annular grooves 9 and the depression 11A at one end of said series are communicated with each other through a shallow communicating groove 13, while the other of the peripheral annular grooves 10 and a predetermined one of the depressions in said series 11X are communicated with each other by means of a communicating hole 14 which opens into the upper portion of the inside wall of said depression 11X at the position shallower than the set position of the communicating grooves 12 and 13. A communicating hole 15 is formed in the body of the centrifugal rotor 8, which opens into the depression 11X at the position shallower than the set position of the above-mentioned communicating grooves 12 and 13 in the depthward direction of the depression and lower said set position in vertical direction. Said hole 15 serves to communicate said depression 11X and a measuring chamber consisting of a liquid reservoir 16 formed in the body 8 of the rotor. A communicating hole 17 is formed in the upper portion of said liquid reservoir 16 to communicate the liquid reservoir to the outside. Thus the centrifugal rotor R is constructed. In FIG. 6, the numeral 18 designates a tube inserted in a measuring light transmitting portion 19 formed in the liquid reservoir 16.

In the embodiment as shown in FIGS. 6–10, the centrifugal rotor is formed with ten shallow depressions 11 having substantially semi-spherical shape, the total volume of said depressions being about 1.5 ml (each depression having a volume of about 0.15 ml).

Figure 8:
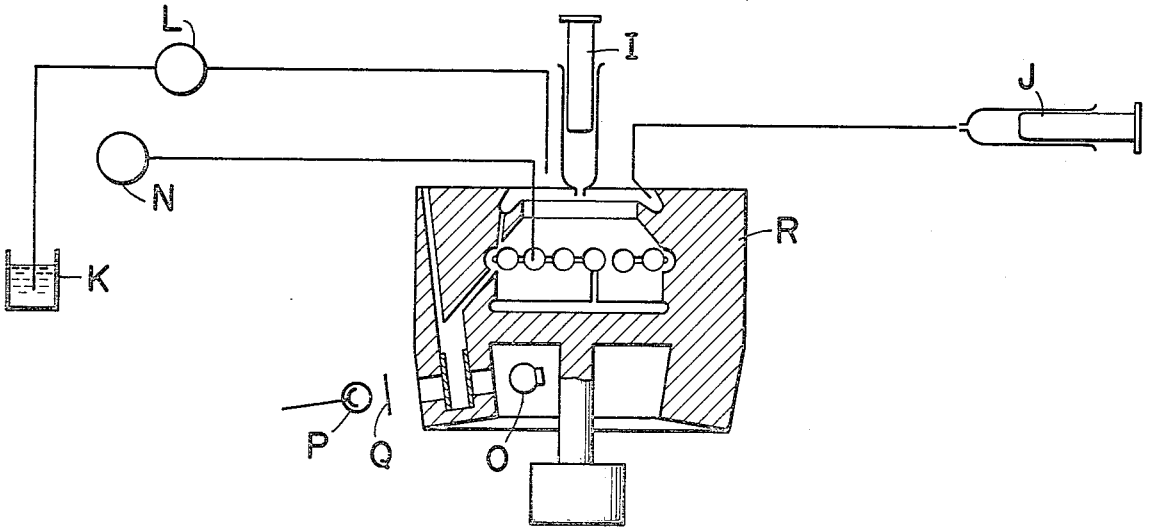
FIG. 8 is a diagrammatic view illustrating the operation of centrifugal separation, separate collection and mixing of components of a solution and washing and drying of the inside of the rotor.
Figure 9:
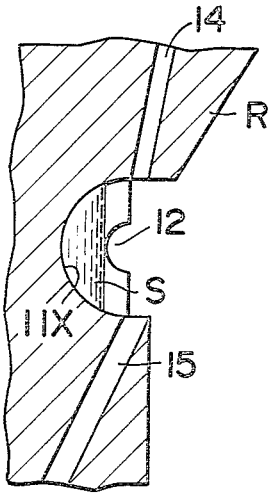
FIGS. 9 and 10 are diagrammatic views illustrating the principle of the separate collection of the components.
Figure 10:
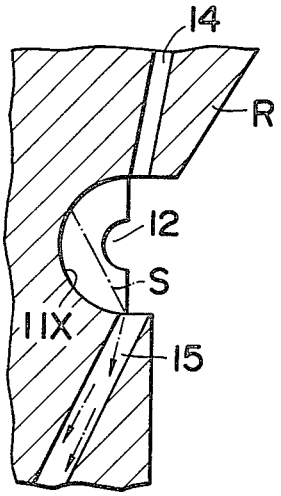

Referring to FIG. 8, which illustrates the operation of centrifugal separation and separate collection, this system is shown including an injector I for injecting a sample of solution, an injector J for injecting a diluting liquid, a tank K of washing liquid, a pump L for feeding the washing liquid, a blowing pump N, a measuring light source O, a measuring photoelectric tube P and an interference filter Q of 470 nm.

In operation, when 1 ml of blood added with a small amount of heparin is injected from the injector I to the bottom of the rotor at the rate of 1 ml/min., while the rotor 8 is driven at 3000 RPM, the blood is passed, under the centrifugal effect, from the annular groove 9 through the communicating groove 13 into the depression 11A, then successively through the respective communicating grooves 12 and the respective depressions 11. During the passage as above, the blood is separated in the respective shallow depressions 11 under the centrifugal effect at high efficiency, without producing slippage. In the embodiment as shown in these figures, the blood cells are positively precipitated in the respective ones of the first three depressions of the series, including the end depression 11A, while the supernatant liquid, the blood plasma, is collected in the fourth and subsequent depressions 11.

Then the rotating speed of the rotor is reduced to 100 RPM and 1.35 ml of water is injected from the injector J into the annular groove 10. Owing to the reduction of the rotating speed of the rotor, the liquid level of the sample solution contained in the respective depressions 11 varies from the vertical state, to the lowered and inclined state (see FIGS. 9 and 10), so that the blood plasma S accumulated in the desired depression 11X among the fourth and subsequent depressions is displaced from the position shown in FIG. 9 to the position shown in FIG. 10. Accordingly, the blood plasma flows through the communicating hole 15 into the liquid reservoir 16 in automatic manner, and at the same time the water injected from the injector J passes through the communicating hole 14 into the depression 11X, where it serves to wash the blood plasma in said depression and then flows into the reservoir 16. By measuring the concentration of the blood plasma flown into the reservoir by means of the spectrometer consisting of light source O photoelectric tube P and interference filter Q, it was determined that the blood plasma was correctly diluted to ten times.

Then the pump L is actuated to eject about 100 ml of the washing liquid toward the inside wall of the rotor to wash the same, and then the pump N is actuated to eject air toward the inside wall of the rotor for about 20 seconds to dry the same. Then the rotating speed of the rotor is reduced to 3000 RPM, so that the solution contained in the reservoir 16 is discharged under the centrifugal effect through the communicating hole 17 to the outside. Thus the apparatus completes one cycle of operation and is ready for receiving the next amount of sample. By repeating the above cycles, it is possible to perform the separation, separate collection and measurement of the required amount of components of a solution intermittently and continuously at high efficiency.

In the embodiment as described above, if substrate solution of enzyme contained in blood plasma (such as, transamylase, LDH enzyme or the like) is used in place of the water injected from the injector J, the substrate is decomposed in the liquid reservoir 16 under the action of said enzyme, and consequently it is possible to determine the amount of the enzyme contained in the blood plasma by measuring the speed of decomposition of the substrate by means of the above-mentioned spectroscopic instrument.

It will be understood that the solution in the depression 11X can be introduced into the liquid reservoir 16 as it is, even when any water or solution such as substrate solution is not added.

Now, the third embodiment of the present invention will be described with reference to FIG. 11.

Figure 7:
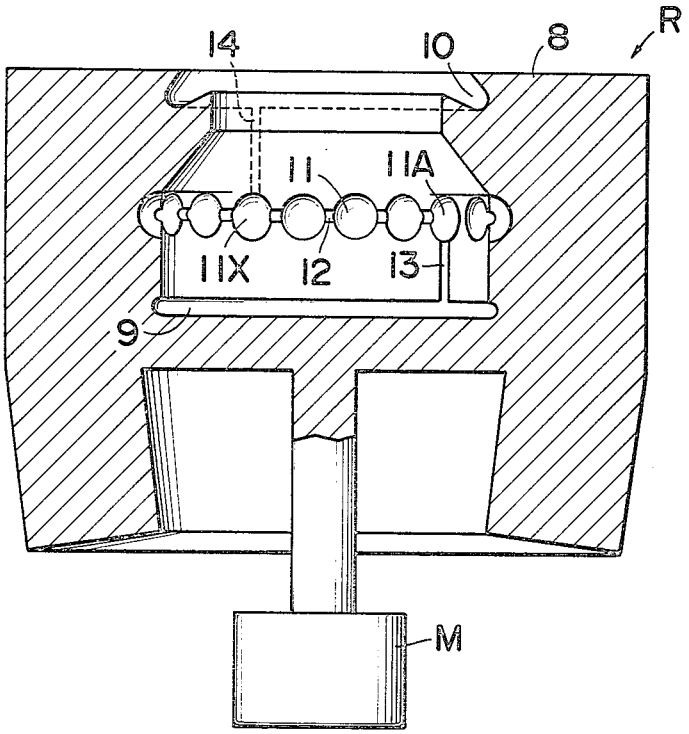
FIG. 7 is a sectional view showing another essential part.
Figure 11:
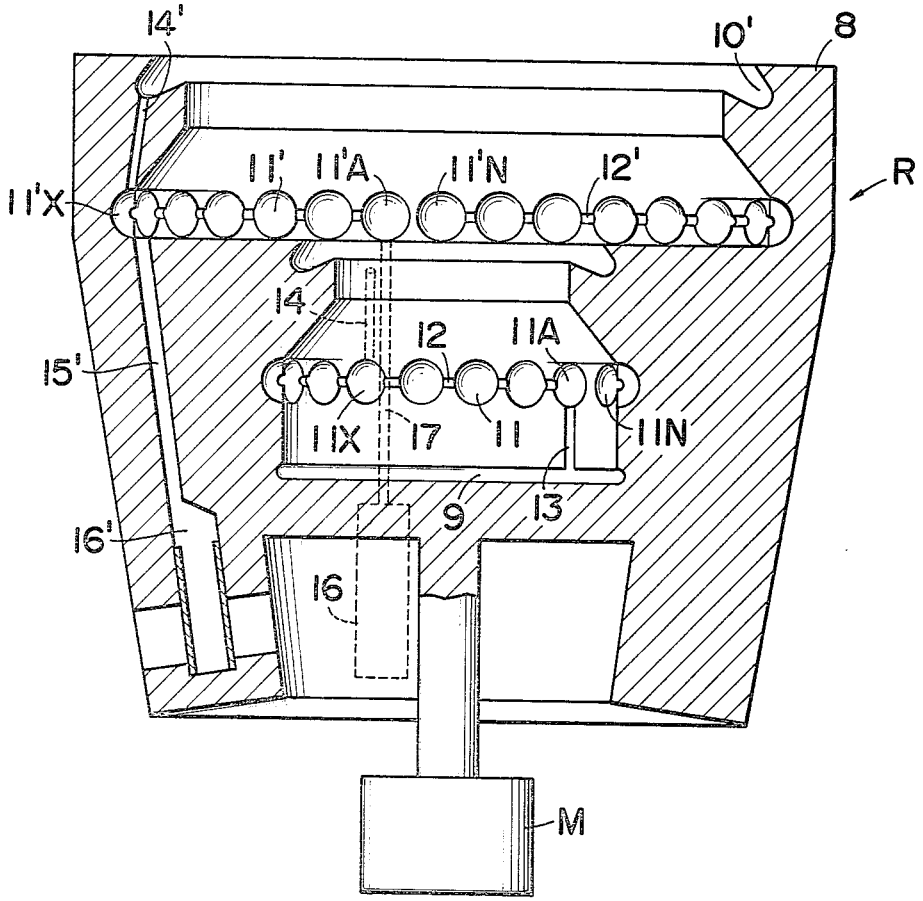
FIG. 11 is a sectional view showing the essential part of another form of the rotor according to the present invention.

FIG. 11 illustrates an apparatus for carrying out the centrifugal separation employing the method according to the present invention. This apparatus includes a centrifugal rotor having the construction as shown in FIGS. 6 and 7, with additional construction in which the centrifugal rotor R has an upwardly extending portion which is formed, at its inside, with an annular groove 10', depressions 11', communicating grooves 12' and a communicating hole 14', which are similar to the above-described parts 10, 11, 12 and 14, respectively, and the desired one of the depressions 11'X communicating with the annular groove 10' through said hole 14' is communicated with another liquid reservoir 16' by means of a communicating hole 15' which opens into said depression 11'X at the position shallower than the set position of the groove 12' in the depthward direction of the depression and lower than said set position in the vertical direction. Thus the centrifugal rotor R is constructed.

After the same processing operation as in the above embodiment is carried out, using the centrifugal rotor as shown in FIG. 11, to introduce the blood plasma into the reservoir 16, the rotating speed of the rotor is increased again to 3000 RPM. Then the blood plasma in the reservoir 16 flows through the communicating hole 17 into the depression 11'A, then through the respective communicating grooves 12' to successively fill the respective depressions 11' each having about 0.15 ml.

Then the rotating speed of the rotor is decreased to 100 RPM and 1.35 ml of water is injected from the injector into the annular groove 10'. Owing to the decrease of the rotating speed of the rotor, the liquid level of the blood plasma in the respective depressions 11', which has been diluted to ten times, varies from the vertical state to the lowered and inclined state, so that the diluted blood plasma accumulated in the desired depression 11'X flows through the communicating hole 15' connected with said depression 11'X into the reservoir 16' in automatic fashion and at the same time the water injected into the annular groove 10' from the injector flows through the communicating hole 14' into the depression 11'X, thereby washing the diluted blood plasma contained in said depression, and then flows into the reservoir 16'. By measuring the concentration of the blood plasma by means of a spectrometer, it was determined that the blood plasma was correctly diluted to ten times.

It will be understood from the above detailed description that the characteristic features of the present invention reside in firstly that the depressions formed in the inside wall of the rotor are shallow and the sedimentation distance of the precipitating component is short, so that the components of a sample solution, which is being passed successively through a plurality of depressions, are separated in short time, depending on the difference of the sedimentation speed; secondly that any desired component in the separated components can be taken out in reliable and rapid manner only by introducing said component from the annular groove through a tube to the outside or by changing the rotating speed of the rotor; thirdly that it is possible to displace the sample solution, as desired, from one position in the rotor to another position having different radius of rotation, namely, the position of different centrifugal force, while the rotor is rotating; fourthly that the volume of the solution filling the depression is always constant, so that the sample solution can be distributed at a predetermined volume in rapid manner and consequently mixing of predetermined volumes of two liquids can be realized in easy and precise manner; and fifthly that the inside of the rotor can be washed and dried while it is rotating, so that it is possible to realize the intermittent and continuous processing, allowing separation and separate collection of components of a sample at high efficiency.

What is claimed is:

1. A method for centrifugal separation of components of a solution, using a centrifugal rotor including a hollow body having at least two annular peripheral grooves formed in the inside thereof with a suitable distance held therebetween and a series of depressions formed in the inside wall of said rotor body, in which one of said annular grooves and the depression at one end of said series are communicated with each other and the other of the annular grooves and the depression at the other end of said series are communicated with each other, while the respective adjacent depressions are communicated with each other but the depressions at said one end and said other end of said series are not communicated, said method comprising injecting the solution into one of said annular grooves, moving the solution successively through the respective depressions, under the centrifugal effect of the rotor, while subjecting the components of the solution to the centrifugal separation, making the separated precipitate component to deposit in the depressions and discharging the subnatant component from the other annular groove.

2. A method for centrifugal separation of components of a solution, using a centrifugal rotor including a hollow body having at least one annular peripheral groove formed in the inside thereof, a series of depressions formed in the inside wall of said rotor body, in which said annular groove and the depression at one end of said series are communicated with each other and the respective adjacent depressions are communicated with each other through a communicating groove while the depressions at one end and the other end of said series are not communicated together, a communicating hole which opens into a desired one of said depressions at the position shallower than the set position of said communicating groove in the depthward direction of the depression and lower than said set position in the vertical direction, and a liquid reservoir formed in said rotor body and communicating with said depression through said communicating hole, said method comprising injecting the solution into the annular groove, moving and distributing said solution successively through the respective depressions under the centrifugal effect of the rotating rotor while subjecting the components of the solution to the centrifugal separation, and then decreasing the rotating speed of the rotor, whereby the solution contained in the depression into which said communicating hole opens is displaced toward the side of the opening of said communicating hole so that said solution is introduced through said hole into said liquid reservoir.

3. An apparatus for centrifugal separation of components of a solution, comprising a centrifugal rotor including a hollow body having at least two annular peripheral grooves formed in the inside thereof with a suitable distance held therebetween and a series of depressions formed in the inside wall of said rotor body, in which one of said annular grooves and the depression at one end of said series are communicated with each other and the other of the annular grooves and the depression at the other end of said series are communicated with each other, while the respective adjacent depressions are communicated with each other but the depressions at said one end and said other end are not communicated together.

4. An apparatus for centrifugal separation of components of a solution, comprising a centrifugal rotor including a hollow body having at least one annular peripheral groove formed in the inside thereof, a series of depressions formed in the inside wall of said rotor body, in which said annular groove and the depression at one end of said series are communicated with each other and the respective adjacent depressions are communicated with each other through a communicating groove while the depressions at one end and the other end of said series are not communicated together, a communicating hole which opens into a desired one of said depressions at the position shallower than the set position of said communicating groove in the depthward direction of the depression and lower than said set position in the vertical direction, and a liquid reservoir formed in said rotor body and communicating with said depression through said communicating hole.

* * * * *